United States Patent [19]

Kodan

[11] Patent Number: 4,774,731

[45] Date of Patent: Oct. 4, 1988

[54] WAVE POOL

[75] Inventor: Norihisa Kodan, Tokyo, Japan

[73] Assignee: Nippon Kokan Kabushiki Kaisha, Tokyo, Japan

[21] Appl. No.: 83,509

[22] Filed: Aug. 7, 1987

[30] Foreign Application Priority Data

May 27, 1987 [JP] Japan ..... 62-127909

[51] Int. Cl.[4] ..... A47K 3/10

[52] U.S. Cl. ..... 4/491; 4/661; 405/79

[58] Field of Search ..... 4/491, 661; 405/79

[56] References Cited

U.S. PATENT DOCUMENTS

| | | | |
|---|---|---|---|
| 3,693,195 | 9/1972 | Richard | 4/491 |
| 4,062,192 | 12/1977 | Biewer | 4/491 X |
| 4,170,898 | 10/1979 | Salter | 4/491 |
| 4,276,661 | 7/1981 | Baker | 4/491 |
| 4,276,664 | 7/1981 | Baker | 4/491 |
| 4,467,483 | 8/1984 | Bastenhof | 4/491 |
| 4,515,500 | 5/1985 | Bastenhof | 4/491 X |
| 4,522,535 | 6/1985 | Bastenhof | 4/491 X |
| 4,539,719 | 9/1985 | Schuster et al. | 4/491 |
| 4,558,474 | 12/1985 | Bastenhof | 4/491 |
| 4,692,949 | 9/1987 | Dunn | 4/491 |

FOREIGN PATENT DOCUMENTS 61-141381 6/1986 Japan .

*Primary Examiner*—Henry K. Artis

*Attorney, Agent, or Firm*—Frishauf, Holtz, Goodman & Woodward

[57] ABSTRACT

A wave pool comprises a plurality of waterways, each having a wave-making device for generating waves at one end of the respective waterways and an opening at the other end, the bottoms of the waterways sloping upwards in the advancing direction of the waves which are generated by the wave-making devices. A pool is arranged adjacent to the openings of the waterways, the waterways opening into the pool. The plurality of waterways cross mutually on an extension of advancing direction lines of the generated waves. The pool is deeper in the center area thereof and shallower at the periphery thereof.

23 Claims, 1 Drawing Sheet

WAVE POOL

BACKGROUND OF THE INVENTION

1. Field of the Invention

The present invention relates to a wave pool, and more particularly to a wave pool for surf-riding.

2. Description of the Prior Art

Waves are indispensable to surf-riding. For good surf-riding, the waves should be high in height and long in period but also steep enough to break at their top along the crest line. More preferably, those waves should be rich in variations. But, such place as can supply such preferred waves is not so often found everywhere. In addition, surfing places are greatly affected by weather and sea conditions. For these reasons, an artificial surfing place which can always supply waves fit for surfing is in demand.

Prior art surfing training facilities are disclosed in Japanese Patent Application Laid Open (KOKAI) No. 141381/86 wherein:

(1) A long pool is equipped with a bottom sloping upwards gently, and a wave-making device is set at the deeper side of the long pool; and (2) The long pool serves as a surfing zone, and around the surfing zone a circulating water channel, with which the wave-making device is connected, is installed to be used as a paddling zone.

The above-mentioned prior art surfing training facilities, however, produce waves propagating in the longitudinal direction of the pool only. To produce waves diagonally crossing the longitudinal axis of the pool, or waves of short crest, separated wave flaps and devices controlling the wave-flaps are required. Furthermore, to enable surfing along a wave crest line, the breadth of the pool must be widened and the wave-making equipment must be large in size, corresponding to the increase of the breadth of the pool.

There is known another prior art surfing pool wherein:

(1) a shoal having the shape of a cape projecting out into the sea is formed in front of a wave-making machine; and (2) the produced wave moves forward but is split in two directions along both sides of the shoal.

This pool, however, is disadvantageous in that the area of the shoal becomes an obstacle to surf-riding.

SUMMARY OF THE INVENTION

It is an object of the invention to provide a wave pool which produces a broad surfing zone and waves rich in variations.

In accordance with the present invention, a surfing pool comprises a plurality of waterways, each having a wave-making device for generating waves at one end of the waterways and an opening at one end; a bottom of each of the waterways sloping upwards toward a propagating direction of the waves generated by the wave-making device; and a pool installed adjacent to the opening.

Other objects and advantages of the present invention will become apparent from the detailed description to follow, taken in conjunction with the appended drawings.

BRIEF DESCRIPTION OF THE INVENTION

DESCRIPTION OF THE PREFERRED EMBODIMENT

Figure 1:
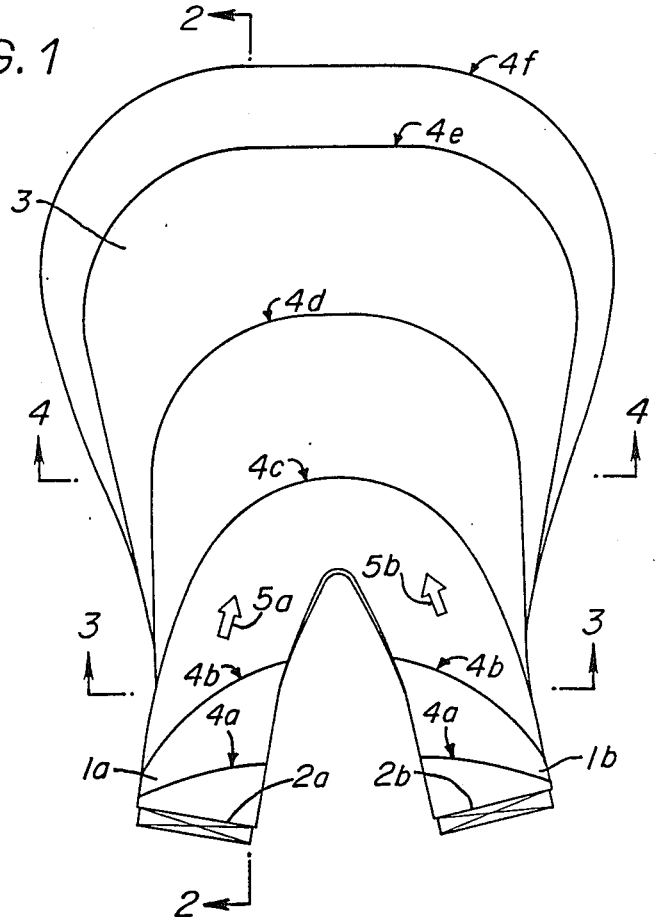
FIG. 1 is a plan view showing an embodiment of a surfing pool according to the present invention.

FIG. 1 illustrates a plan view of an embodiment of a wave pool of the present invention. As seen in FIG. 1, a surfing pool comprises two independent waterways 1*a* and 1*b*; wave-making devices 2*a*, 2*b* for generating waves respectively, fitted to respective waterways 1*a* and 1*b* at each end of the waterways; and pool 3 arranged adjacent to each of the waterways 1*a*, 1*b*. Reference numerals 4*a*–4*f* denote contour lines which get deeper step by step in order from 4*a* toward 4*f*. Waterway 1*a* and waterway 1*b* are arranged so that extensions of each of arrows 5*a* and 5*b*, which each show advancing directions of generated waves, cross each other. Wave-making devices 2*a*, 2*b* are mounted to ends of waterways 1*a* and 1*b*, respectively, and the waves which are generated by wave-making devices 2*a*, 2*b* advance in the longitudinal direction of the respective waterways 1*a* and 1*b*. The other ends of the respective waterways are opened into pool 3 so as not to disturb the forward movement of the generated waves. The waves generated in waterways 1*a*, 1*b*advance into pool 3 which is arranged adjacent to said other ends of the waterways 1*a*, 1*b*. The generated waves which have advanced into pool 3 become different types of waves, for example a chopping wave, from those waves generated through waterways 1*a*, 1*b*, since the waves generated in waterways 1*a*, 1*b*are designed to cross each other on the extension of each of arrows 5 showing the advancing direction of the generated waves.

Figure 2:
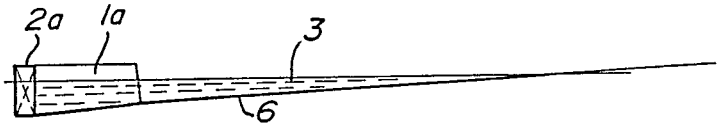
FIG. 2 is a longitudinal sectional view taken on line 2—2 of FIG. 1.

FIG. 2 represents a longitudinal sectional view taken on line 2—2 of FIG. 1, showing a longitudinal section of bottom 6 of waterways 1*a*, 1*b*and of pool 3. The water depth is the deepest at the positions where wave-making devices 2*a*, 2*b*are located. The bottom 6 slopes upwardly gently so that the water depth becomes more shallow as one gets farther from the wave-making devices 2*a*, 2*b*.

Figure 3:
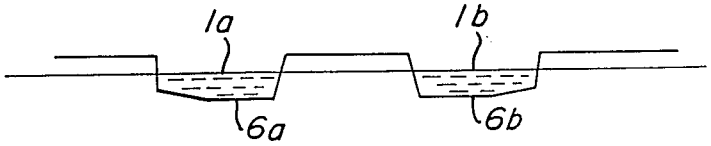
FIG. 3 is a transverse sectional view taken on line 3—3 of FIG. 1.

FIG. 3 represents a transverse sectional view taken on line 3—3 of FIG. 1, showing a transverse section of bottoms 6*a*, 6*b* of waterways 1*a*, 1*b*, respectively. The bottoms 6*a*, 6*b* slope upwards as the waterways 1*a*, 1*b* get more remote outwardly from the center line of pool 3 (line 2—2). The shapes of waterways 1*a* and 1*b*, each, are symmetrical with regard to the center line 2—2.

Figure 4:
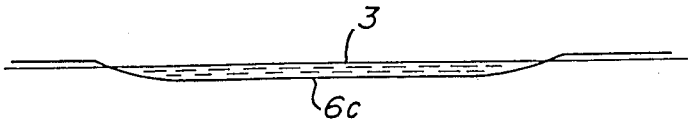
FIG. 4 is a transverse sectional view taken on line 4—4 of FIG. 1.

As shown in FIG. 4, the transverse section of the bottom 6*c* of pool 3 shows that pool 3 is deep at the center part thereof and becomes more shallow outwardly toward the outer side portions thereof. Furthermore, the peripheral parts of the pool 3 are bow-shaped like a real beach of a sea coast line, to thereby reduce the feeling-gap arising out of the use of an artificial pool.

By virtue of making the shapes of the bottom portions 6*a*, 6*b* and 6*c* as described above referring to FIGS. 2 through 4, the produced waves break along the wave crest line from the shallow sides of the bottom, and, thus, become suitable for surf-riding.

For generating waves, a flap type wave maker, a wave-making plunger or an inclined wave-making plunger can be used.

In this embodiment, two sets of waterways 1*a*, 1*b* are equipped with respective wave-making devices 2*a*, 2*b*. If a similar third waterway and associated wave-making device is added to pool 3, and waves generated from three sets of the waterways and respective wave-making devices are allowed to cross one another, then waves richer in variation can be produced. Of course, more than three sets of waterways and associated wave-making devices can be used.

The present invention gives the following effects:

(1) The generated waves break along the wave crest line one after another in sequence, since the bottom wall of the waterways and a part of the bottom wall of the pool are both sloped, crossing the advancing direction of the waves at a right angle.

(2) Simple waves generated from simple wave-making devices can be changed into waves abundant in variation in a surfing zone without complicated control, since there is provided a plurality of waterways equipped with wave-making devices set at each end of the respective waterways, and the waves generated therefrom are arranged to cross one another.

(3) A surfing zone which is wide, safe and suitable for surf-riding can be provided, and further, the shape of the surfing zone is not restricted so much.

EXAMPLE

A wave pool was constructed in compliance with the following specifications:

Length of Wave Pool 3: 180 m
Breadth of Wave Pool 3: 140 m
Breadth of Waterways 1*a*, 1*b*: 30 m
Surf-riding Distance: 120 m
Wave Height: 3 m
Water Depth
4*a*: −6 m
4*b*: −3 m
4*c*: −2 m
4*d*: −1 m
4*e*: −0 m
4*f*: −0.5 m Water waves generated from wave-making devices 2*a* and 2*b* proceed along the inclined bottoms of waterways 1*a*, 1*b*. The waves begin to break from shallower sides. The breaks of the waves occur one after another in sequence and the last break finishes approximately on the center line of the pool.

By simultaneous operation of wave-making devices 2*a* and 2*b*, chopping waves and short crested waves are formed through interference of independently generated waves, each having a different advancing direction.

It should be noted that, depending on the maximum wave height, shape and availability of area, plane shape and the shape of the bottom of the wave pool can be changed.

I claim:

1. A wave pool comprising:

at least two waterways, each having opposite end portions;

a wave-making device mounted at one end portion of each of the respective waterways for generating respective waves in said waterways, said waves advancing in a substantially linear advancing direction in said respective waterways;

each of said waterways having a bottom which slopes upwardly in the advancing direction of the waves generated by the respective wave-making devices;

said at least two waterways being arranged relative to each other such that an extension of advancing direction lines of the waves generated in each of said waterways mutually cross each other; and a pool arranged adjacent to the other end portions of said at least two waterways, said other end portions opening into said pool such that said advancing waves from said at least two waterways combine in said pool.

2. The wave pool of claim 1, wherein said at least two waterways each have a bottom which slopes upwardly in transverse section as the bottom is farther from a center line of the pool.

3. The wave pool of claim 1, wherein said pool has a bottom which slopes upwardly in the advancing direction of the generated waves.

4. The wave pool of claim 3, wherein said pool bottom is deeper in the vicinity of the center line of the pool and shallower at the periphery of said pool in transverse section.

5. The wave pool of claim 4, wherein said pool has a peripheral portion which is generally bow-shaped.

6. The wave pool of claim 1, wherein said pool has a bottom which is deeper in the vicinity of the center line of the pool and shallower at the periphery of said pool in transverse section.

7. The wave pool of claim 1, wherein said pool has a peripheral portion which is generally bow-shaped.

8. The wave pool of claim 1, wherein said wave-making device comprises a flap type wave maker.

9. The wave pool of claim 1, wherein said wave-making device comprises a wave-making plunger.

10. The wave pool of claim 1, wherein said wave-making device comprises an inclined wave-making plunger.

11. The wave pool of claim 1, wherein said waterways are elongated in the advancing direction of the respective waves generated therein.

12. The wave pool of claim 11, wherein said at least two elongated waterways have respective longitudinal axes which are arranged at an angle to each other.

13. A wave pool comprising:

at least two waterways, each having opposite end portions;

a wave-making device mounted at one end portion of each of the respective waterways for generating respective waves in said waterways, said waves advancing in a substantially linear advancing direction in said respective waterways;

each of said waterways having a bottom which slopes upwardly in the advancing direction of the waves generated by the respective wave-making devices;

said at least two waterways each have a bottom which further slopes upwardly in transverse section as the bottom is farther from a center line of the pool; and a pool arranged adjacent to the other end portions of said at least two waterways, said other end portions opening into said pool such that said advancing waves from said at least two waterways combine in said pool.

14. The wave pool of claim 13, wherein said pool has a bottom which slopes upwardly in the advancing direction of the generated waves.

15. The wave pool of claim 14, wherein said pool bottom is deeper in the vicinity of the center line of the pool and shallower at the periphery of said pool in transverse section.

16. The wave pool of claim 15, wherein said pool has a peripheral portion which is generally bow-shaped.

17. The wave pool of claim 16, wherein said pool has a bottom which is deeper in the vicinity of the center line of the pool and shallower at the periphery of said pool in transverse section.

18. The wave pool of claim 13, wherein said pool has a peripheral portion which is generally bow-shaped.

19. The wave pool of claim 13, wherein said wave-making device comprises a flap type wave maker.

20. The wave pool of claim 13, wherein said wave-making device comprises a wave-making plunger.

21. The wave pool of claim 13, wherein said wave-making device comprises an inclined wave-making plunger.

22. The wave pool of claim 13, wherein said waterways are elongated in the advancing direction of the respective waves generated therein.

23. The wave pool of claim 22, wherein said at least two elongated waterways have respective longitudinal axes which are arranged at an angle to each other.

* * * * *

UNITED STATES PATENT AND TRADEMARK OFFICE

CERTIFICATE OF CORRECTION

PATENT NO. : 4,774,731

DATED : Oct. 4, 1988

INVENTOR(S) : KODAN

It is certified that error appears in the above-identified patent and that said Letters Patent is hereby corrected as shown below:

Column 3, line 43, delete "4e: - 0 m", insert
-- 4e: 0m --
line 44, delete " "4f: -0.5 m" insert
-- 4f: 0.5 m --

Column 5, Claim 17, delete "claim 16" insert -- claim 13 --

Signed and Sealed this

Eighteenth Day of July, 1989

*Attest:*

*Attesting Officer*

DONALD J. QUIGG

*Commissioner of Patents and Trademarks*